United States Patent [19]

Magari et al.

[11] 4,416,809

[45] Nov. 22, 1983

[54] GRANULAR DETERGENT COMPOSITION

[75] Inventors: Teruo Magari, Funabashi; Mitsuyoshi Yazaki; Masayoshi Nakamura, both of Chiba, all of Japan

[73] Assignee: Lion Corporation, Tokyo, Japan

[21] Appl. No.: 373,714

[22] Filed: Apr. 30, 1982

[30] Foreign Application Priority Data

Apr. 30, 1981 [DE] Fed. Rep. of Germany ..... 66590

[51] Int. Cl.[3] ..... C11D 1/12

[52] U.S. Cl. ..... 252/557; 252/108; 252/121; 252/174.18; 252/174.19; 252/174.24; 252/538

[58] Field of Search ..... 252/557, 538, 108, 121, 252/117, 174.18, 174.19, 174.24

[56] References Cited

U.S. PATENT DOCUMENTS

| | | | |
|---|---|---|---|
| 3,219,584 | 11/1965 | Stirton et al. | 252/538 |
| 3,274,117 | 9/1966 | Stein et al. | 252/557 |
| 3,413,221 | 11/1968 | Gotte et al. | 252/538 |
| 3,632,517 | 1/1972 | Stirton et al. | 252/109 |
| 3,954,643 | 5/1976 | Krings et al. | 252/121 |

FOREIGN PATENT DOCUMENTS 2804324 8/1978 Fed. Rep. of Germany .

*Primary Examiner*—John E. Kittle
*Assistant Examiner*—Hoa Van Le
*Attorney, Agent, or Firm*—Armstrong, Nikaido, Marmelstein & Kubovcik

[57] ABSTRACT

A granular detergent composition is described containing an α-sulfo fatty acid ester salt and having good granular or powder properties, without containing any phosphate, and also having a less decomposable property of an α-sulfo fatty acid ester salt contained therein. This granular detergent composition comprises (a) at least one α-sulfo fatty acid ester salt having the general formula [I]:

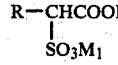

[I]

wherein R is an alkyl group having 4 through 20 carbon atoms, $R_1$ is an alkyl group having 1 through 6 carbon atoms, and $M_1$ is a salt-forming pair ion;

(b) at least one fatty acid soap having the general formula [II]:

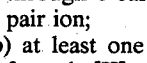

[II]

wherein $R_2$ is an alkyl group having 8 through 20 carbon atoms, and $M_2$ is an alkali metal; and (c) at least one polycarboxylic acid salt, the total content of the components (a) and (b) in the composition being 20% through 80% by weight, the weight ratio of the component (a) to the component (b) being within the range of from 4/1 through ¼, and the content of the component (c) in the composition being 1% through 20% by weight.

11 Claims, No Drawings

GRANULAR DETERGENT COMPOSITION

BACKGROUND OF THE INVENTION

1. Field of the Invention

The present invention relates to a granular (or powdered) detergent composition containing an α-sulfo fatty acid ester salt. More specifically, it relates to a granular detergent composition having good granular or powder properties, without containing any phosphate, and having a less decomposable property of an α-sulfo fatty acid ester salt contained therein.

2. Description of the Prior Art

It is known in the art that various attempts have been made to develop a granular detergent composition having good granular or powder properties and good detergency, without using any phosphate, since the use of a phosphate in a detergent composition should be avoided from the view point of pollution. One attempt heretofore made was to use a new builder, typically an A-type zeolite. Another was to use, as an active detergent component, various surface active agents exhibiting good detergency even in water having a high hardness. Of these surface active agents, δ-sulfo fatty acid ester salts are to be noted since they have excellent detergency and soil dispersibility and also are not sensitive against calcium. Granular detergent compositions containing, as an active detergent component, these surface active agents are disclosed in British Patent Specification No. 1368736 and U.S. Pat. No. 3,915,881.

The granular detergent compositions containing the above-mentioned α-sulfo fatty acid ester salts have, however, the problem in that α-sulfo fatty acid ester salts are susceptible to hydrolysis during the production process or the storage thereof. The α-sulfo fatty acid ester salts are inherently likely to be hydrolyzed and be converted into α-sulfo fatty acid salts by cleavage of the ester linkage. The resultant α-sulfo fatty acid salts are only slightly soluble in water and have poor detergency.

In order to eliminate the above-mentioned problem, various attempts have been made to prevent the hydrolysis of α-sulfo fatty acid ester salts in the production of granular detergent compositions containing the same. For example, Japanese Patent Liad-Open Application (Kokai) No. 52-28507/1977 discloses that while the use of alkaline builder such as sodium silicate together with α-sulfo fatty acid ester salts remarkably decreases the detergency with the lapse of time due to the hydrolysis of α-sulfo fatty acid ester salts and while no use of an alkaline builder causes caking of the granular detergent composition, which remarkably decreases the commercial value of the detergent composition, use of a specific alkaline builder in a specific amount can prevent the decrease in detergency and prevent caking of the granules (or powder). Japanese Patent Laid-Open Application (Kokai) No. 52-117908 teaches the use of polyethylene glycol in a granular detergent composition containing α-sulfo fatty acid ester salts, in order to prevent hydrolysis of α-sulfo fatty acid ester salts during spray drying of detergent composition slurry containing α-sulfo fatty acid ester salts. Furthermore, Japanese Patent Laid-Open Application (Kokai) No. 50-151905/1975 discloses that (a) α-sulfo fatty acid ester salts in the form of granules or powder not only tend to form lower aldehydes or ketones due to the oxidative decomposition of the α-sulfo fatty acid ester salts themselves or their contaminants, i.e., unreacted fatty acid esters, but also tend to form fatty acid disalts due to the cleavage of the ester linkage and (b) the above-mentioned oxidative decomposition and cleavage of the ester linkage are further promoted when the granules of α-sulfo fatty acid ester salts are produced by means of spray drying. This publication proposes the use of hindered phenolic compounds and hydroxy polycarbonic acid salts to prevent the above-mentioned oxidative decomposition and cleavage of the ester linkage.

SUMMARY OF THE INVENTION

Accordingly, the objects of the present invention are to eliminate the above-mentioned problems of the prior art and to provide a granular detergent composition having good granular or powder properties and having a less decomposable property of an α-sulfo fatty acid ester salt contained therein during the production and storage thereof.

Other objects and advantages of the present invention will be apparent from the following description.

In accordance with the present invention, there is provided a granular detergent composition comprising:

(a) at least one α-sulfo fatty acid ester salt having the general formula [I]:

$$R-\underset{\underset{SO_3M_1}{|}}{CH}COOR_1 \qquad [I]$$

wherein R is an alkyl group having 4 through 20 carbon atoms, $R_1$ is an alkyl group having 1 through 6 carbon atoms, and $M_1$ is a salt-forming pair ion;

(b) at least one fatty acid soap having the general formula [II]:

$$R_2COOM_2 \qquad [II]$$

wherein $R_2$ is an alkyl group having 8 through 20 carbon atoms, and $M_2$ is an alkali metal; and (c) at least one polycarboxylic acid salt, the total content of the components (a) and (b) in the composition being 20% through 80% by weight, the weight ratio of the component (a) to the component (b) being within the range of from 4/1 through 1/4, and the content of the component (c) in the composition being 1% through 20% by weight.

DESCRIPTION OF THE PREFERRED EMBODIMENTS

The α-sulfo fatty acid ester salts having the above-mentioned general formula [I] usable as a component (a) in the present invention can be produced from fatty acids having 6 through 22 carbon atoms in any conventional manners. Desirable starting fatty acids are, for example, hardened tallow fatty acids and hardened palm oil fatty acids. The alkyl groups R and $R_1$ in the above-mentioned general formula [I] representing α-sulfo fatty acid ester salts may be either linear or branched alkyl groups. The desirable alkyl group $R_1$ in the general formula [I] is a methyl, ethyl, n-propyl, or i-propyl group. The salt-forming pair ion $M_1$ in the general formula [I] is desirably an alkali metal such as sodium or potassium.

The fatty acid soaps usable as a component (b) in the present invention can be produced from fatty acids having 9 through 21 carbon atoms in any conventional manners. Desirable starting fatty acids are, for example, tallow fatty acids, lard fatty acids, palm oil fatty acids, coconut oil fatty acids, cottonseed oil fatty acids, rice bran oil fatty acids, and soybean oil fatty acids. The desirable salt-forming pair ion $M_2$ in the above-mentioned general formula [II] is an alkaline metal such as sodium or potassium.

The granular detergent composition of the present invention must contain from 20% through 80% by weight, desirably 20% through 60% by weight, in total, of the α-sulfo fatty acid ester salts (i.e., component (a)) and the fatty acid soaps (i.e., component (b)). The weight ratio of the component (a) to the component (b) (i.e., (a)/(b)) must be within the range from 4/1 through 1/4, desirably 3/1 through 1/4. The detergent composition containing less than 20% by weight, in total, of the components (a) and (b) has an insufficient detergency, whereas the detergent composition containing more than 80% by weight, in total, of the components (a) and (b) has a poor granule or powder property. A weight ratio of the component (a) to the component (b) outside the above-defined range undesirably increases the viscosity of the detergent slurry which is subjected to spray drying for the production of the granular detergent composition, making the granulation operation difficult and worsening the granule or powder property of the spray dried product.

The polycarboxylic acid salts usable as a component (c) in the present invention are water-soluble salts of compounds having two or more carboxy groups in one molecule thereof. Examples of such polycarboxylic acid salts desirably used in the present invention are sodium citrate, sodium oxalate, sodium malonate, sodium succinate, sodium tartrate, sodium maleate, sodium fumarate, sodium dl-malate, sodium phthalate, and trisodium trinitroacetate. These polycarboxylic acid salts are compounded into the composition in an amount of from 1% through 20% by weight, desirably 5% through 20% by weight, of the composition. The detergent composition containing less than 1% by weight of the component (c) has poor granule or powder property. On the other hand, the use of an excessive amount of the component (c) is not desirable for economic reason since the polycarboxylic acid salts are a relatively expensive detergent builder. Accordingly, the upper limit of the amount of the component (c) should be 20% by weight of the detergent composition.

The granular (or powdered) detergent composition of the present invention can be produced in any conventional manner. For instance, the granular detergent composition of the present invention can be produced by simply mixing, in the form of powder, particles or granules, the above-mentioned α-sulfo fatty acid ester salt, fatty acid soap, and polycarboxylic acid salt together with any conventional optional ingredients. However, the present inventors prefer to produce the granular detergent composition by first preparing a detergent composition slurry containing the above-mentioned α-sulfo fatty acid ester salt, fatty acid soap, polycarboxylic acid salt, and, optionally, any conventional ingredients in water, followed by spray drying.

Examples of conventional ingredients which may be optionally incorporated into the detergent composition of the present invention are: anionic surface active agents such as alkylbenzene sulfonates, alkyl sulfonates, α-olefin sulfonates, alkyl sulfates, and alkyl polyether sulfates; nonionic surface active agents such as alkyl ethoxylates, alkylphenyl ethoxylates, and alkylalkanol amides; various ampholytic surface active agents; strong alkaline builders such as sodium silicate and sodium carbonate; neutral builders such as zeolites; anticaking agents; optical brightening agents; and perfumes. In the case where the granular detergent composition of the present invention is produced by means of spray drying, an α-sulfo fatty acid ester salt in a detergent slurry is hydrolyzed to form an α-sulfo fatty acid salt if a strong alkaline builder is present together with the polycarboxylic acid salt. However, the hydrolysis of the α-sulfo fatty acid ester salt in the detergent slurry does not occur so long as the polycarboxylic acid salt, alone or together with neutral builder, is used as a builder component. For this reason, when strong alkaline builders such as sodium silicate and sodium carbonate are used, the granular detergent composition must be produced by a powder or granule mixing process. Furthermore, the α-sulfo fatty acid ester salt coexistent with the fatty acid soap and the polycarboxylic acid salt in the detergent slurry is not subjected to any substantial hydrolysis by heating over the short time period required in the spray drying.

EXAMPLES

The present invention now will be further illustrated by, but is by no means limited to, the following examples. The angle of repose, disalt content (%), and granule strength of the granular detergent composition were determined according to the following methods.

(a) Angle of repose (a discharge method)

A rectangular parallelopiped vessel having a volume of approximately 300 cc is filled with a sample at room temperature. One of the vertical surfaces of the vessel is then gently removed to discharge the sample. The angle of the slope formed by the discharged sample is measured.

(b) Disalt content (%)

A predetermined amount of a sample is extracted by 90% aqueous ethanol solution, whereby α-sulfo fatty acid ester salt is dissolved in the extracted solution and α-sulfo fatty acid disalt is precipitated. The amounts of the α-sulfo fatty acid ester salt and the α-sulfo fatty acid disalt are determined by means of the methylene blue back titration method.

The disalt content (%) is determined from the following equation.

$$\text{Disalt content (\%)} = \frac{B}{A+B} \times 100$$

A: α-sulfo fatty acid ester salt content in the sample
B: α-sulfo fatty acid disalt content in the sample

(c) Granule strength

A sample having a temperature of 50° C. through 60° C. is filled into a cylindrical cell having a diameter of 5 cm and is molded into a cylindrical shape by applying a 3 kg load for 3 minutes. The load necessary for crushing the molded sample is determined.

EXAMPLE 1

Granular detergent compositions having the compositions (% by weight) listed in Table 1 were prepared by means of a spray drying method. The angle of repose, disalt content (%), and granule strength of these compositions were determined in the manners described above. Spray drying was carried out by spraying a detergent composition slurry having a temperature of 80° C. in a disc type dryer having a diameter of approximately 2 m under the conditions of a hot air temperature 200° C. and an exhaust air temperature of approximately 100° C.

The results are shown in Table 1.

TABLE 1

| Run No. | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| α-SFMe*1 | 50 | 25 | 25 | 30 | 30 | 44 | 33 | 22 | 15 | 15 | 15 | 30 | 30 | 30 | — | — |
| α-SFMe*2 | — | — | — | — | — | — | — | — | — | — | — | — | — | — | 30 | 50 |
| SOAP*3 | — | 25 | 25 | — | — | 11 | 22 | 33 | 35 | 40 | 45 | 20 | 20 | 20 | 20 | — |
| Sodium citrate | — | — | — | 10 | — | 10 | 10 | 10 | 10 | 10 | 10 | — | 10 | 5 | 10 | 10 |
| Zeolite*4 | — | — | — | — | 10 | — | — | — | — | — | — | — | — | — | — | — |
| Sodium carbonate | — | 31.5 | — | — | — | — | — | — | — | — | — | — | — | — | — | — |
| Sodium silicate | — | 4 | 4 | — | — | — | — | — | — | — | — | — | — | — | — | — |
| Water content | 2 | 2 | 2 | 3 | 3 | 3 | 3 | 3 | 3 | 3 | 3 | 3 | 3 | 3 | 3 | 3 |
| Sodium sulfate | ← | ← | ← | ← | ← | ← | ← | | Balance | → | → | → | → | → | → | → |
| Angle of repose (°) | 70 | 60–65 | 60–65 | 60 | 55 | 55 | 55 | 55 | 55 | 55 | 55 | 65–70 | 50–55 | 60–65 | 50–55 | 65–70 |
| Disalt content (%) | 1 | 20 | 14 | 1 | 2.7 | 2.1 | 0.4 | 2.7 | 0.5 | 0.3 | 0.6 | — | 1.5 | 1.3 | 2.3 | 1.1 |
| Granule strength (kg) | >6 | 2.5 | 2.5 | >6 | >6 | 1.4 | 0.3 | 0.1 | 0.1 | 0.1 | 0.1 | >6 | 0.1 | 0.2 | 0.1 | >6 |

*1Sodium α-sulfo hardened tallow fatty acid methylester
*2Sodium α-sulfo hardened palm oil fatty acid methylester
*3Tallow fatty acid soap
*4A-type zeolite

EXAMPLE 2

Granular detergent compositions having the composition of that of run NO. 13 of example 1, except that sodium citrate was replaced with the compounds listed in Table 2, were prepared in the same manner as in example 1.

The angle of repose, disalt content, and granule strength were determined. The results are shown in Table 2. The disalt contents of the compositions were not more than 3%.

TABLE 2

| Run No. | Compound | Angle of repose(°) | Granule strength (kg) | Remarks |
|---|---|---|---|---|
| 17 | NTA*1 | 50–55 | 0.1 | |
| 18 | Sodium tatrate | 50–55 | 0.2 | |
| 19 | Sodium malate | 45–55 | 0.3 | |
| 20 | Sodium succinate | 65–70 | 0.1 | |
| 21 | Sodium maleate | 55–60 | 0.2 | |
| 22 | PEG*2 | 70–75 | 1.0 | Less stability for heat |
| 23 | Stearyl alcohol | 65–70 | >6 | |
| 24 | Amisol CMF*3 | — | — | Could not sprayed due to the high viscosity of slurry |
| 25 | STP*4 | — | — | |
| 26 | TSPP*5 | 60–65 | >6 | |
| 27 | Potassium alum | 65–70 | >6 | |

*1Sodium nitrilotriacetate
*2Polyethylene glycol #6000
*3Coconut fatty acid monoethanol amide
*4Sodium tripolyphosphate
*5Tetrasodium pyrophosphate

EXAMPLE 3

Detergent builders shown below were mixed with the detergent composition of run NO. 11 of example 1 in a weight ratio of the composition to the builder of 4:1. The angle of repose and granule strength of the resultant mixture were determined. As is clear from the results shown below, both mixtures have good granule properties.

| Builder compounded | Sodium carbonate | Sodium tripolyphosphate |
|---|---|---|
| Angle of repose(°) | 50 to 55 | 50 to 55 |
| Granule strength (kg) | 0 to 0.1 | 0 to 0.1 |

EXAMPLE 4

A powdered soap composition or a granular synthetic detergent composition having the composition shown below was mixed with the granular detergent composition of run No. 13 of example 1.

| Powdered soap composition | % by weight |
|---|---|
| Tallow soap | 50 |
| Sodium silicate ($Na_2O/SiO_2$ = 1/2.2) | 6 |
| Water | 8 |
| Sodium carbonate | Balance |

| Granular synthetic detergent composition | % by weight |
|---|---|
| Sodium $C_{13}$ linear alkylbenzene sulfonate | 10 |
| Sodium $C_{14}$–$C_{18}$ α-olefine sulfonate | 10 |
| Sodium solicate ($Na_2O/SiO_2$ = 1/2.3) | 10 |
| Sodium carbonate | 10 |
| Synthetic zeolite (average particle size = 1.3μ) | 15 |
| Polyethylene glycol (average molecular weight = 6000) | 2 |
| Water content | 5 |
| Sodium sulfate | Balance |

The angle of repose and granule strength of the resultant mixture were determined. The results are shown in Table 3 below.

TABLE 3

| | Powdered soap | | | | Granular synthetic detergent | |
|---|---|---|---|---|---|---|
| Mixing ratio*1 | Soap only | 1/1 | ½ | ⅓ | Detergent only | 1/19 |
| Angle of repose (°) | 55–60 | " | " | " | 50–55 | " |
| Granule strength (kg) | 0.4 | 1.0 | 1.2 | 1.3 | 0.5 | 0.7 |

TABLE 3-continued

| | Powdered soap | Granular synthetic detergent |
|---|---|---|
| strength (kg) | | |

*[1]Wt. of composition of run No. 13/Powdered soap or detergent

We claim:

1. A granular detergent composition comprising:

(a) at least one α-sulfo fatty acid ester salt having the general formula [I]:

$$R-\underset{\underset{SO_3M_1}{|}}{CH}COOR_1 \quad [I]$$

wherein R is a alkyl group having 4 through 20 carbon atoms, $R_1$ is an alkyl group having 1 through 6 carbon atoms, and $M_1$ is a salt-forming pair ion;

(b) at least one fatty acid soap having the general formula [II]:

$$R_2COOM_2 \quad [II]$$

wherein $R_2$ is an alkyl group having 8 through 20 carbon atoms, and $M_2$ is an alkali metal; and (c) at least one polycarboxylic acid salt having 2 to 8 carbon atoms, the total content of the components (a) and (b) in the composition being 20% through 80% by weight, the weight ratio of the component (a) to the component (b) being within the range of from 4/1 through 1/4, and the content of the component (c) in the composition being 1% through 20% by weight.

2. A granular detergent composition as claimed in claim 1 wherein the α-sulfo fatty acid ester salt is derived from a fatty acid having 6 through 22 carbon atoms.

3. A granular detergent composition as claimed in claim 2 wherein the fatty acid is a hardened tallow fatty acid or a hardened palm oil fatty acid.

4. A granular detergent composition as claimed in claim 1 wherein the alkyl group $R_1$ in the general formula [I] is methyl, ethyl, n-propyl, or i-propyl group.

5. A granular detergent composition as claimed in claim 1 wherein the salt-forming pair ion $M_1$ is sodium or potassium.

6. A granular detergent composition as claimed in claim 1 wherein the fatty acid soap is derived from an fatty acid having 9 through 21 carbon atoms.

7. A granular detergent composition as claimed in claim 6 wherein the fatty acid is a tallow fatty acid, a lard fatty acid, a palm oil fatty acid, a coconut oil fatty acid, a cottonseed oil fatty acid, a rice bran oil fatty acid, or a soybean oil fatty acid.

8. A granular detergent composition as claimed in claim 1, wherein the salt-forming pair ion $M_2$ is sodium or potassium.

9. A granular detergent composition as claimed in claim 1, wherein the polycarboxylic acid salt is a salt of a polycarboxylic acid selected from the group consisting of citric acid, oxalic acid, malonic acid, succinic acid, tartaric acid, maleic acid, fumaric acid, malic acid, phthalic acid and nitrilotriacetic acid.

10. A granular detergent composition as claimed in claim 1, wherein the at least one polycarboxylic acid salt is an alkali metal salt.

11. A granular detergent composition as claimed in claim 10, wherein the alkali metal is sodium.

* * * * *

UNITED STATES PATENT AND TRADEMARK OFFICE

CERTIFICATE OF CORRECTION

PATENT NO. : 4,416,809

DATED : November 22, 1983

INVENTOR(S) : MAGARI ET AL

It is certified that error appears in the above-identified patent and that said Letters Patent are hereby corrected as shown below:

On the cover page of the patent, under the heading "Foreign Application Priority Data", "[DE] Fed. Rep. of Germany" should be changed to --[JP] Japan--.

Signed and Sealed this

*Fifth* Day of *June 1984*

[SEAL]

*Attest:*

GERALD J. MOSSINGHOFF

*Attesting Officer*

*Commissioner of Patents and Trademarks*